United States Patent [19]

Takahashi et al.

[11] Patent Number: 4,569,616

[45] Date of Patent: Feb. 11, 1986

[54] DRIVING PROCESS OF ENLARGED TUNNEL

[75] Inventors: Yoshiyuki Takahashi; Fumihiro Koiso, both of Tokyo, Japan

[73] Assignee: Mitsui Kensetsu Kabushiki Kaisha, Tokyo, Japan

[21] Appl. No.: 557,445

[22] Filed: Dec. 2, 1983

[30] Foreign Application Priority Data

Dec. 3, 1982 [JP] Japan ..... 57-211356
Dec. 3, 1982 [JP] Japan ..... 57-211358
Dec. 3, 1982 [JP] Japan ..... 57-211359

[51] Int. Cl.[4] ..... E21D 11/00

[52] U.S. Cl. ..... 405/150; 405/138; 405/141; 405/146

[58] Field of Search ..... 405/138, 139, 140, 141, 405/146, 150; 175/53, 61, 62, 108, 263, 264, 319, 350; 299/31

[56] References Cited

U.S. PATENT DOCUMENTS

| | | | |
|---|---|---|---|
| 167,442 | 9/1875 | Dowd | 405/141 X |
| 1,278,932 | 9/1918 | Hughes | 175/62 X |
| 2,743,087 | 4/1956 | Layne et al. | 175/350 X |
| 3,523,426 | 8/1970 | Lauber | 299/31 X |

FOREIGN PATENT DOCUMENTS

| | | | |
|---|---|---|---|
| 459285 | 9/1968 | Switzerland | 405/141 |

*Primary Examiner*—Dennis L. Taylor
*Attorney, Agent, or Firm*—Birch, Stewart, Kolasch & Birch

[57] ABSTRACT

A driving process for enlarging a tunnel wherein a primary shield machine is driven along an ordinary diametrical tunnel to a predetermined region to be enlarged. An enlarged starting base is formed in the rear of the primary shield machine. An enlarging shield machine is assembled in the enlarged base. Thereafter, the primary shield machine and the enlarging shield machine are both driven forward along the predetermined region of enlargement to construct an enlarged tunnel.

5 Claims, 19 Drawing Figures

DRIVING PROCESS OF ENLARGED TUNNEL

BACKGROUND AND OBJECTS OF THE INVENTION

1. Field of the Invention

This invention relates to a driving process of an enlarged tunnel wherein an ordinary diametrical tunnel is partly made into an enlarged tunnel. More particularly, the invention is directed to a driving process of an enlarged tunnel, wherein a predetermined region of an ordinary diametrical tunnel to be enlarged may be constructed with a direct saving in time and labor as compared to previous methods of constructing an ordinary diametrical tunnel in that predetermined region.

2. Description of Background Art

As for a process for making a part of an ordinary diametrical tunnel into an enlarged tunnel, hithertofore it has been usual that a shaft is excavated from the surface of the ground at a predetermined region to be enlarged of an ordinary diametrical tunnel previously constructed. Various kinds of excavation machines are introduced through the shaft into the ordinary diametrical tunnel and a predetermined region of the ordinary diametrical tunnel is enlarged by an assembled driving machine.

However, this process is defective because in recent years structures on the surface of the ground such as buildings or the like have been increasing. Thus, it is difficult to acquire the land for making the shaft. Additionally, a great deal of trouble is involved with refilling the shaft after the diametrically enlarging work is finished.

The present inventors have previously proposed a driving process of an enlarged tunnel which makes it unnecessary to excavate the shaft. This process is characterized in that, after an ordinary diametrical tunnel is constructed by a primary shield machine, one end portion of a predetermined region to be enlarged of this tunnel is partly excavated, so that an enlarged starting base is established. An enlarging shield machine is assembled in this starting base, and is driven forward, while primary segments which previously lined the whole area of the predetermined region to be enlarged are removed in order. In this manner, the machine proceeds with an enlargement of the tunnel and at the same time an inner surface of the resultant enlarged portion is lined with secondary segments in order so that an enlarged tunnel extending over the predetermined region is constructed.

This proposed process is advantageous because it improves the conventional working efficiency and economical results can be brought about. Additionally, this process shortens the working time and lowers working costs.

However, especially where the region to be enlarged is a comparatively long one, it is desirable to avoid individual or separate work for making the ordinary diametrical tunnel and the work for making the enlarged tunnel.

Accordingly, this invention has for its object to provide a driving process of an enlarged tunnel wherein work for constructing an ordinary diametrical tunnel along the portion that corresponds to a predetermined region to be enlarged can be omitted. Work for making an enlarged tunnel can be carried out directly. The present invention is characterized in that when a primary shield machine is driven along an ordinary diametrical tunnel and reaches a predetermined region to be enlarged, an enlarged starting base is made in the rear of the primary shield machine, and an enlarging shield machine is assembled in the enlarged base. Thereafter the primary shield machine and the enlarging shield machine are both driven through the predetermined region to be enlarged so as to construct the region into an enlarged tunnel.

DETAILED DESCRIPTION OF THE INVENTION

FIGS. 1–7 show a first embodying example of this invention process. An ordinary diametrical tunnel 2 is constructed by a primary shield machine 1 having a jack means 1*a*. The shield machine 1 is advanced to one end portion of a predetermined region 3 to be enlarged. The inner circumferential surface of the ordinary diametrical tunnel 2 is lined with primary segments 4 in such a manner as described below.

The primary shield machine 1 is driven forward so as to excavate a facing of the ground by expansion of the jack means 1*a* with the primary segments 4 that already line a tunnel 2 earlier excavated being used as a reaction member. After the excavation of the facing, the jack means 1*a* is contracted and the inner circumferential surface of an additional tunnel 2 constructed behind the shield machine thus advanced is lined by an erector means with additional primary segments 4 so that the segments may be connected to the primary segments earlier applied. In this way the boring of the tunnel 2 and the lining thereof with the primary segments 4 are repeated. The above ordinary diametrical tunnel 2 construction procedure is substantially the same as the conventional one.

Figure 1A:
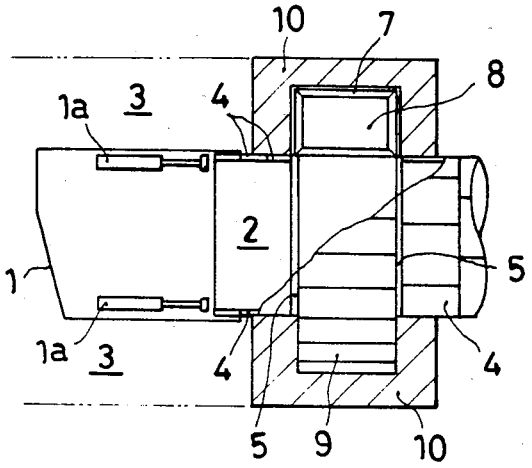
FIG. 1(A) is a partial sectional view showing a construction condition of an enlarged portion used for a starting base in a first embodying example of the present invention.
Figure 1B:
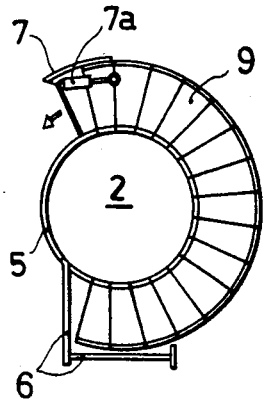
FIG. 1(B) is a cross-sectional view of the driving type shield machine illustrated in FIG. 1(A)

In an illustrated example, the end portion of the ordinary diametrical tunnel 2 lined with the primary segments 4 extends a little across one end of the predetermined region 3 that is located behind the primary shield machine 1. According to this invention, several rings of the foregoing primary segments 4 that are located in the vicinity of the one end of the predetermined region 3 to be enlarged are removed from the inner circumferential surface of the ordinary diametrical tunnel. Opposite edges of an annular ground portion exposed by the removal thereof are applied with respective opposite guide rings 5, 5, as shown in FIG. 1(A) and 1(B). A circumferentially driving type shield machine 7 is positioned in a steel box 6 embedded in a bottom portion of the exposed ground portion. The driving type shield machine 7 is mounted to bridge between two guide rings 5, 5 and is driven circumferentially along the guide rings 5, 5 in the direction shown by the arrow in FIG. 1(B) by repeated expansions of a jack means 7*a* thereof. Thus, an enlarged circular starting base 8 is constructed around the tunnel 2.

The inner surface of the enlarged circular starting base 8 is lined circumferentially with steel-made circumferential segments 9 connected one to another in series, for preventing the surrounding ground from collapsing as the circumferentially driven enlarging shield machine progresses along the tunnel. Depending on the nature of soil of the ground, a stabilizing agent is applied to a circumferential area 10 surrounding the base 8, as shown by oblique lines. The installation of the two guide rings 5, 5 may be so modified that each of them is interposed between the primary segments 4 simultaneously when the ordinary diametrical tunnel 2 is lined with a large number of the primary segments 4.

Figure 2A:
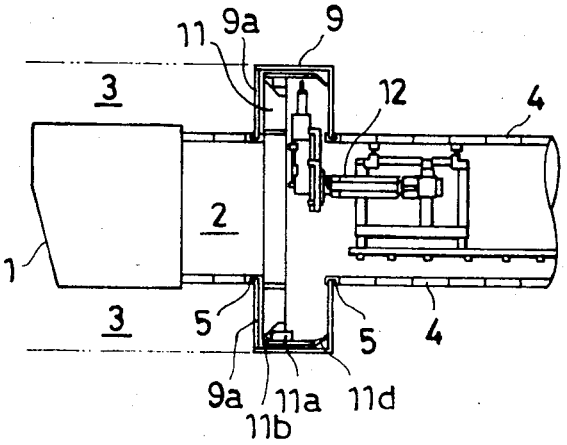
FIG. 2(A) is a sectional view of an assemblying condition of an enlarging shield machine including an erector.
Figure 2B:
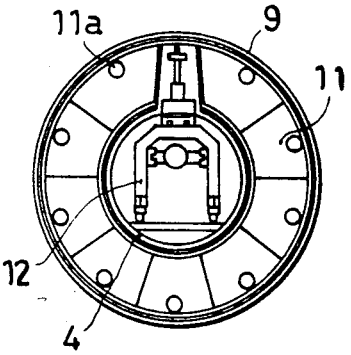
FIG. 2(B) is a cross-sectional view of the erector as illustrated in FIG. 2(A)

Next, as shown in FIGS. 2(A) and 2(B), in the enlarged starting base 8 sector elements are assembled together by an erector means 12 into an enlarging shield machine in the form of a ring.

Figure 3:
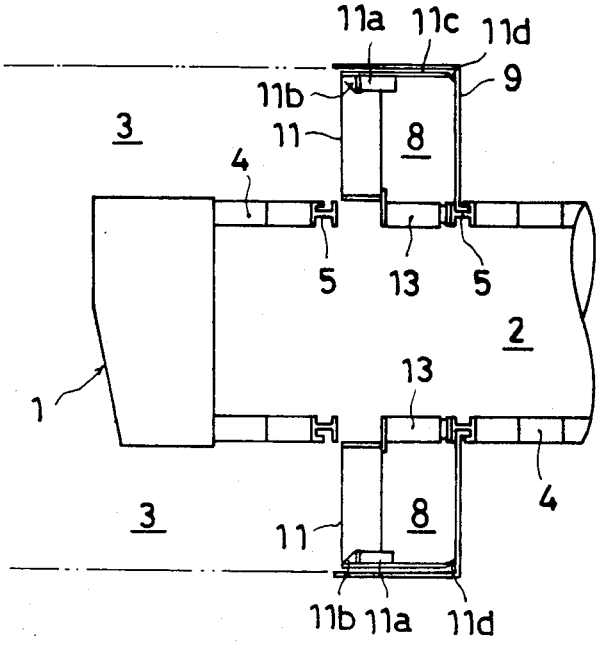
FIGS. 3 and 4 are explanation diagrams showing an initial driving condition thereof.
Figure 4:
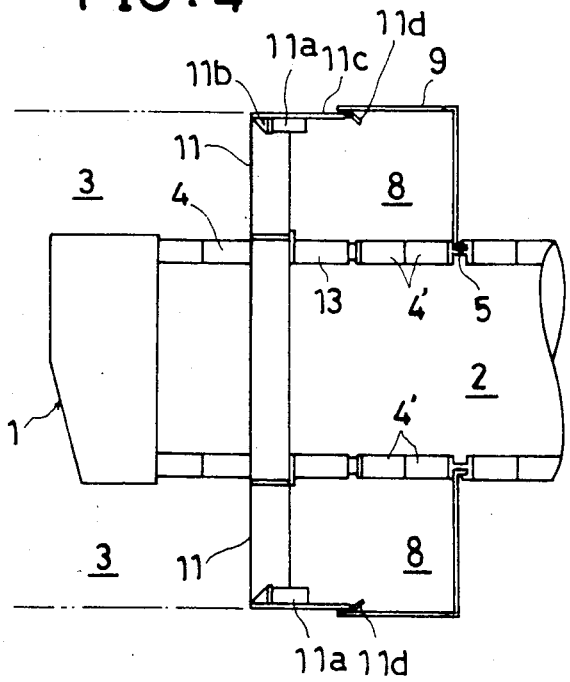

Thereafter, front panels 9*a* of the U-shaped circumferential segments 9 are removed, and a jack means 13 for initial driving, which comprises circularly arranged jacks, is interposed between the enlarging shield machine 11 and the guide ring 5 on the rear side, as shown in FIG. 3. In addition, the front ring 4 and all the primary segments in front of the same are removed. Thereafter, the enlarging shield machine 11 is driven forward by the length of one segment by expanding the jack means 13 by the length of one segment using the orindary segments 4 on the rear side as a reaction means. Provisional segments 4′ are so mounted in a gap formed by the forward driving of the machine 11 so as to be attached to the rear guide ring 5. The enlarging shield machine 11 is driven forward by expansion of the jack means 13 receiving the reaction to the provisional segments 4′. The new provisional segments 4′ are mounted in a newly formed gap and are attached to the previous ones. This process is repeated and in this way the initial driving of the machine 11 is carried out until a tail seal 11*d* of the enlarging shield machine 11 leaves the circumferential segments 9. Thereafter, the initial driving jack means 13 and the provisional segments 4′ are removed.

Figure 5:
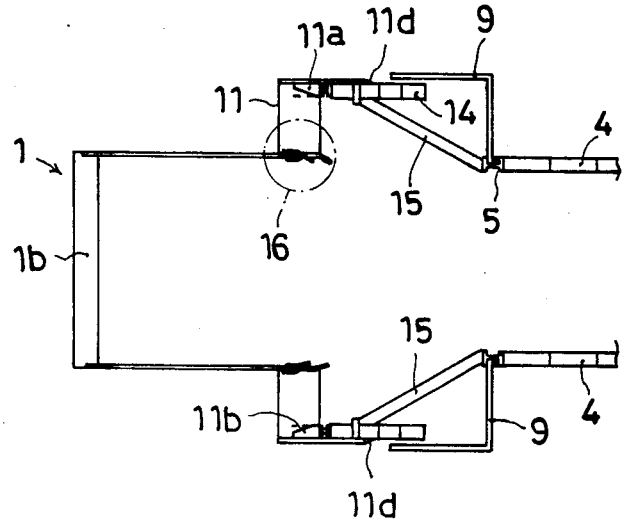
FIG. 5 is an explanation diagram showing a procedure of connection between a primary shield machine and the enlarging shield machine in the same example.

As shown in FIG. 5, secondary segments 14 are attached to the inner surface of the circumferential segments 9. The enlarging shield machine 11 is advanced by expansion of a jack means 11*a*, which comprises circumferentially arranged jacks, of the enlarging shield machine 11 with the secondary segments 14 being used as a reaction means. The ground soil excavated by a front frame-shaped cutter 11*b* of the enlarging shield machine 11 is removed so that an enlarged portion is constructed. The enlarged portion is lined with additional secondary segments 14 which are connected to the foregoing secondary segments 14. When the front frame-shaped cutter 11*b* of the enlarging shield machine 11 is overlapped with a rear end portion of a skin plate 1*c* of the primary shield machine 1, the two shield machines 1, 11 are connected together at the overlapped portions as described below in detail. Oblique reinforcement members 15 are interposed between the primary segments 4 and the secondary segments 14.

Figure 6:
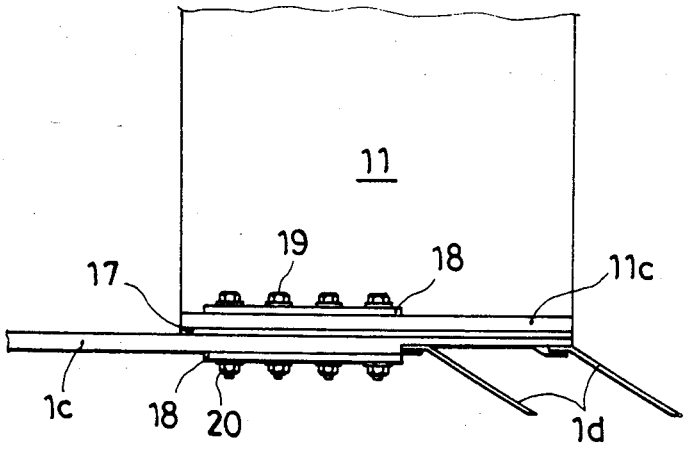
FIG. 6(A) is an enlarged view of a connection between the two shield machines.
FIG. 6(B) is an enlarged view of a connection between the two shield machines.
Figure 6B:
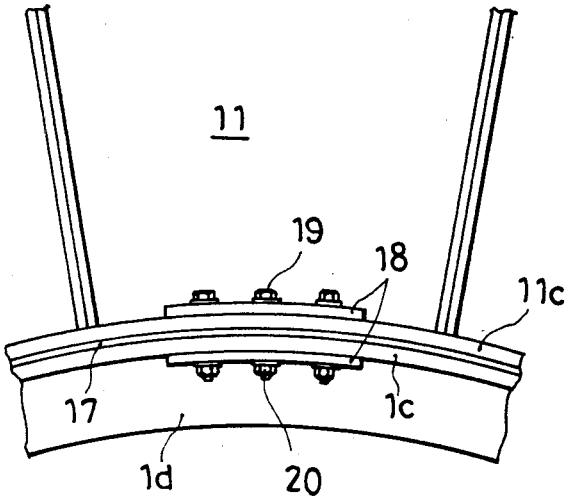

A connective portion 16 between the two shield machines 1, 11 is made as shown in FIG. 6(A) and FIG. 6(B), in such a way that the skin plate 1*c* provided on the rear side of the primary shield machine 1 and having a tail seal 1*d* and the skin plate 11*c* provided on the front side of the enlarging shield machine 11 are positioned one upon another through an adjusting plate 17. Holding plates 18, 18 are applied to both surfaces thereof and are joined together by means of fastening bolts 19 passing therethrough and nuts 20 screwed thereon.

Figure 7:
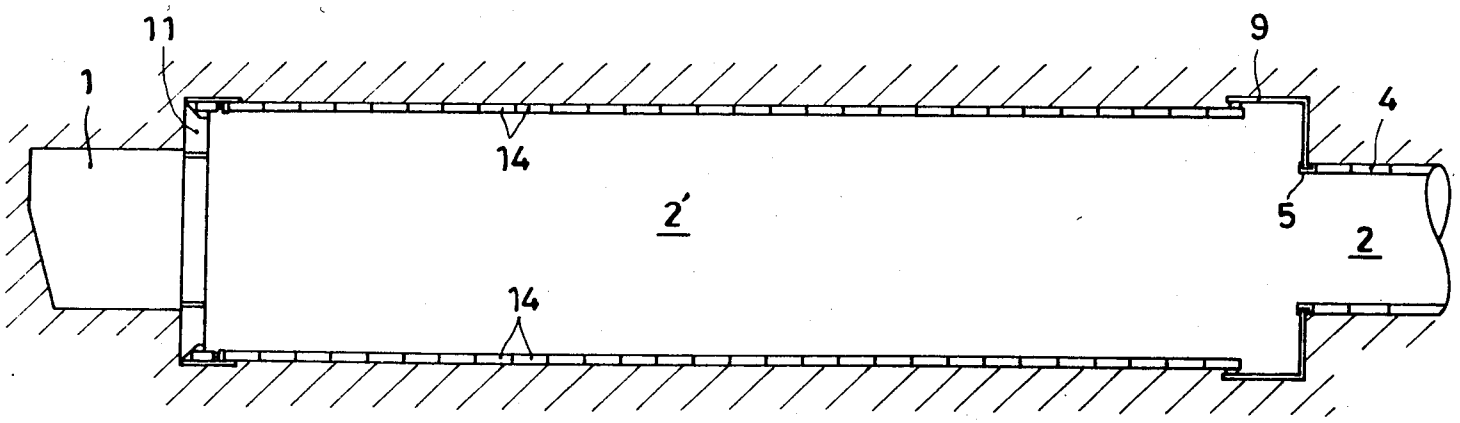
FIG. 7 is a sectional side view of an enlarged tunnel extending over the whole range of the predetermined region of englargement.

The two shield machines 1, 11 thus connected together are simultaneously driven forward toward the remainder ground of the predetermined region to be enlarged by using the jack means 11*a* of the enlarging shield machine 11 as a driving machine receiving reactions from the reinforcement means 15 and the secondary segments 14. In this manner, the ordinary diametrical tunnel is excavated by a frame-shaped cutter 1*b* of the primary shield machine 1 projecting ahead and the surrounding circumferential portion thereof is excavated for enlargement in diameter by the cutter 11*b* of the enlarging shield machine 11 following the same. Thereafter, as shown in FIG. 7, the inner circumferential surface of the resultant enlarged tunnel 2′ thus constructed is lined with secondary segments 14 in order by the foregoing erector means 12 as the combined shield machines 1, 11 are driven forward. After the construction of the enlarged tunnel extending over the whole range of the predetermined region 3 of enlargement is completed, as shown in FIG. 7, the enlarging shield machine 11 is disconnected from the primary shield machine 1 and is disassembled and removed.

In a case where it is desired that an additional ordinary diametrical tunnel 2 is constructed in succession to the above enlarged tunnel making operation, the primary shield machine 1 is further driven forward by the jack means 1*a* in almost the same manner as described before.

By the process of this embodying example, owing to the fact that the primary shield machine 1 and the enlarging shield machine 11 are simultaneously advanced, trouble can be eliminated in that the primary ordinary diametrical tunnel is constructed once and lined with primary segments. Thereafter, the primary segments are removed from the whole range of the predetermined region to be enlarged for making an enlarged tunnel.

Additionally, this process is especially suitable for a situation involving excavating clay or silty soil because the cutter 1*b* of the primary shield machine 1 is provided in front of the cutter 11*b* of the enlarging shield machine 11, so that the ordinary diametrical tunnel 2 may be first excavated and then the surrounding portion thereof is enlarged.

Figure 8:
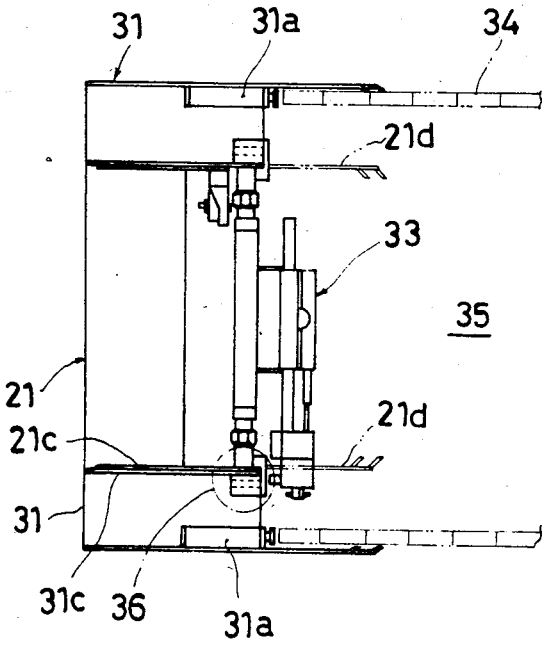
FIG. 8 is an explanation diagram showing a connected condition of a primary shield machine and the enlarging shield machine in a second embodying example of the present invention.
Figure 9A:
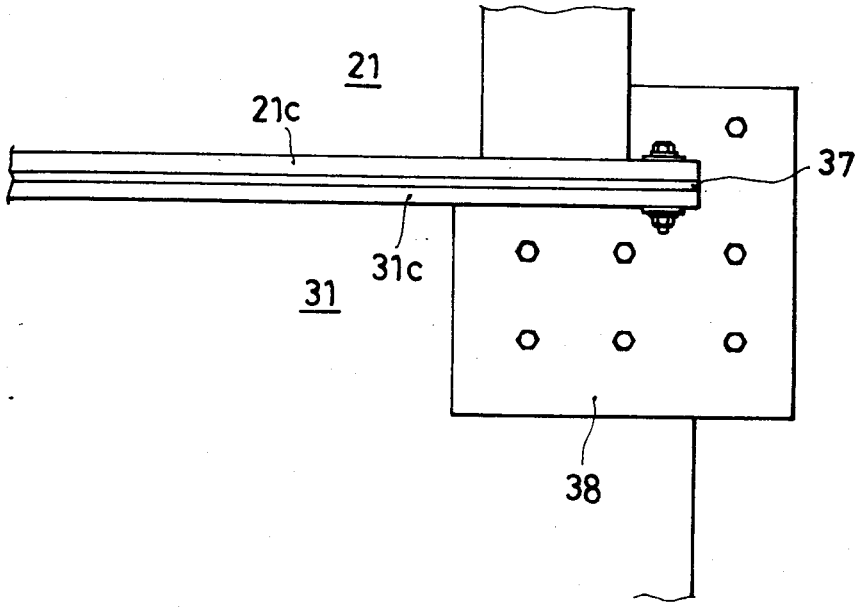
FIG. 9(A) is an enlargement of the connection illustrated in FIG. 8.
Figure 9B:
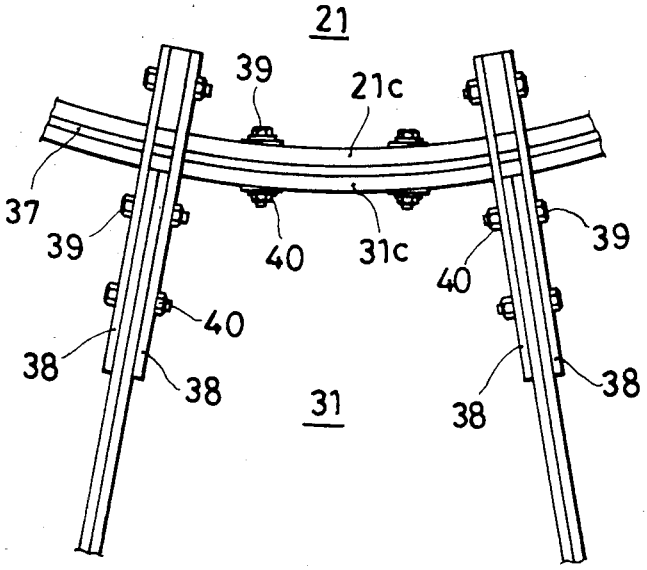
FIG. 9(B) is a more detailed view of the connection illustrated in FIG. 9(A)

A second embodying example of the present invention process will be explained with reference to FIGS. 8 and 9. In this example, an inside primary shield machine 21 and an outside enlarging shield machine 31 are detachably connected together in such a manner that the respective front surfaces for attaching respective cutters are disposed in the same plane. Thereby, an enlarged tunnel is excavated in almost the same manner as in the foregoing first embodying example.

The primary shield machine 21 is provided with a skin plate 21*c* provided therein with a jack means (not shown). A tail portion 21*d* attaches to the skin plate 21*c* and has a tail seal means and is arranged to be detached therefrom when the machine 21 is connected to an enlarging shield machine 31.

The primary shield machine 21 is provided on its rear side with an erector means 33 serving to line secondary segments 34 onto an inner surface of an enlarged tunnel portion 35.

The enlarging shield machine 31 is provided with a skin plate 31*c* provided therein with a jack means 31*a*. The enlarging shield machine 31 is of the type that sector elements thereof are assembled together into an annular one in almost the same manner as in the foregoing first embodying example.

A connective portion 36 between the primary shield machine 21 and the enlarging shield machine 31 is such that the skin plate 21*c* of the primary shield machine 21 and the skin plate 31*c* of the enlarging shield machine 31 are connected to one another. The skin plates 21*c*, 31*c* are provided with an intermediate adjusting plate 37 interposed therebetween. Radial plates joined to the respective skin plates 21*c*, 31*c* are held by holding plates 38, 38 applied to both side surfaces thereof and are interconnected there-through by means of fastening bolts 39 and nuts 40.

The shield machines 21, 31 are connected together in almost the same manner as in the foregoing first embodying example. Namely, an ordinary diametrical tunnel is, firstly, excavated by the primary shield machine 21. After the machine 21 has reached a predetermined region to be enlarged, an enlarged portion serving as an enlarged starting base is formed behind the machine 21. Thereafter, the primary shield machine 21 is connected to the enlarging shield machine 31 which has been assembled and driven forward in the enlarged base.

The interconnected two shield machines 21, 31 are simultaneously driven forward in such a manner that a jack means 31*a* of the enlarging shield machine 31 is used as a driving machine. The secondary segments 34 are applied to an inner surface of the enlarged tunnel portion 35 and are used as reaction means. Thereby, an enlarged tunnel is excavated in the predetermined region to be enlarged. In the case where an ordinary diametrical tunnel is desired to be constructed in succession to constructing the enlarged tunnel, the enlarging shield machine 31 is disconnected from the primary shield machine 21 and is removed after disassembling thereof. Thereafter, the primary shield machine 21 is driven forward by operating the jack means thereof.

The process of this second embodying example is advantageous in that the cutters of the two shield machines 21, 31 act simultaneously on the facing of the ground. The machines are strong enough to withstand the pressure of the earth acting from above, and therefore can cope at a high efficiency with soil containing sand or rocks. In addition, the machines can deal easily with water which may be abundant in certain soil.

Figure 10:
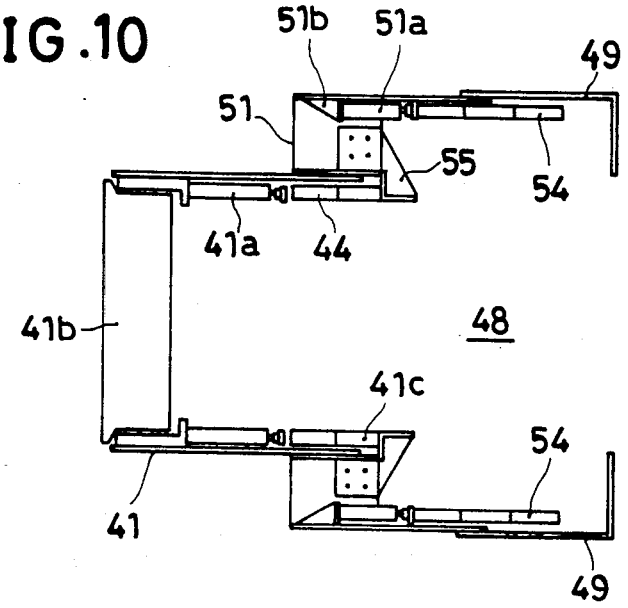
FIG. 10 is an explanation diagram showing a connected condition of the two shield machines in a third embodying example of the present invention.

A third embodying example of the present invention process shown in FIGS. 10 and 11 will be explained as follows. This example is not different in procedure from the foregoing two examples until the inner surface of circumferential segments 49 is lined with secondary segments 54. Thereafter, as shown in FIG. 10, when a front cutter 51*b* of an enlarging shield machine 51 is overlapped with a rear end portion of a skin plate 41*c* of primary shield machine 41, the two shield machines 51, 41 are connected together in such a manner that the enlarging shield machine 51 may be able to be pushed with several rings of primary segments 44 remaining in the rear of the primary shield machine 41.

Figure 11A:
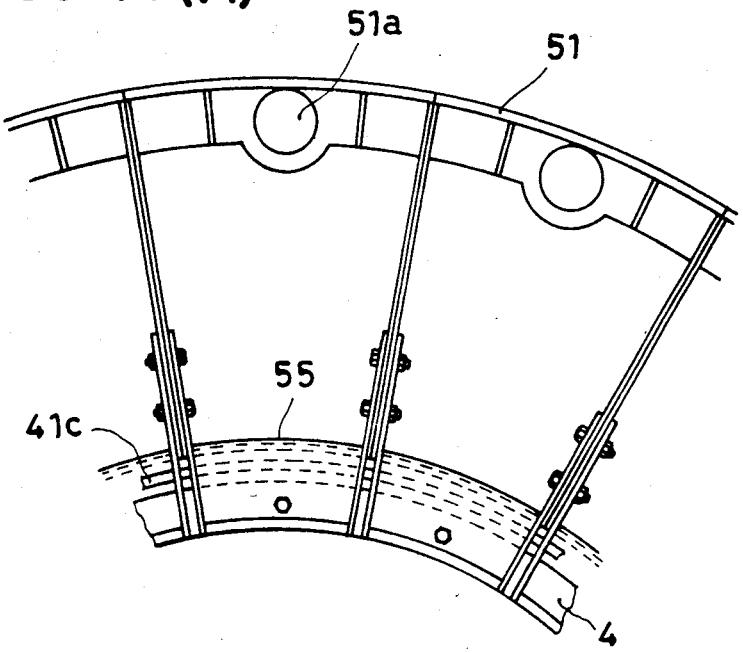
FIG. 11(A) is an enlarged view of the connection between the two shield machines as illustrated in FIG. 10.
Figure 11B:
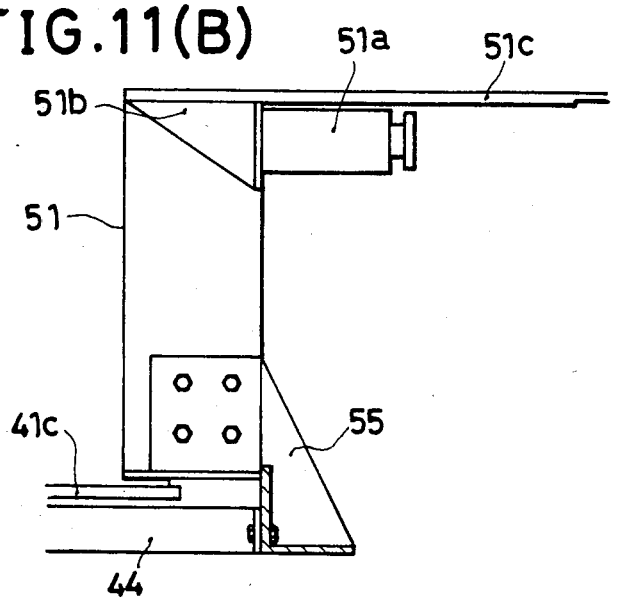
FIG. 11(B) is an enlarged view of the shield machine illustrated in FIG. 10.

In more detail, a connective portion thereof is as shown in FIGS. 11(A) and 11(B). Namely, the two machines 51, 41 are connected together through an annular connecting member 55 which is fixed by bolts at its inner end portion to the rear end ring of the primary segments 44 and is fixed by bolts at its other end to radial plates of the enlarging shield machine 51. Thus, the primary shield machine 41 and the enlarging shield machine 51, which are engaged one with another through the several rings of the primary segments 44, can operate to make an enlarged tunnel in such a manner as described below.

When a jack means 51*a* of the enlarging shield machine 51 is expanded under the condition that a jack means 41*a* of the primary shield machine 41 is maintained contracted, the enlarging shield machine 51 is driven forward by the length of one segment by a reaction resulting from the secondary segments 54 receiving the expanding jack means 51*a*.

The primary segments 44 connected to the enlarging shield machine 51 through the connecting member 55 is driven forward by the length of one segment in almost the same manner as in the case of a pushing pipe process. At the same time the jack means 41*a* positioned in front of the primary segments 44 is pushed thereby and consequently the primary shield 41 is also driven forward by the length of one segment by the jack means 44.

Thereafter, the expanded jack means 51*a* of the enlarging shield machine 51 is contracted, and the inner circumferential surface of the enlarged portion newly constructed by the above forward driving is applied with a new ring of secondary segments 54, by the erector means in such a manner that the new ring of the segments 54 is connected to the front one of the rings of the secondary segments 54 previously applied.

Thereafter, in the same manner as the above, the enlarging shield machine 51 and the primary shield machine 41 are simultaneously driven forward by a pushing force of the jack means 51*a* of the enlarging shield machine 51. This action is repeated and thereby the ground in the predetermined region of enlargement is excavated so that an enlarged tunnel is constructed.

A fourth embodying example of the present invention process shown in FIG. 12 will be explained as follows. This example is not different from the third example until the primary shield machine 41 and the enlarging shield machine 51 are engaged one with another through several rings of the primary segments 44. Thereafter, an enlarged tunnel is formed as described below.

Figure 12A:
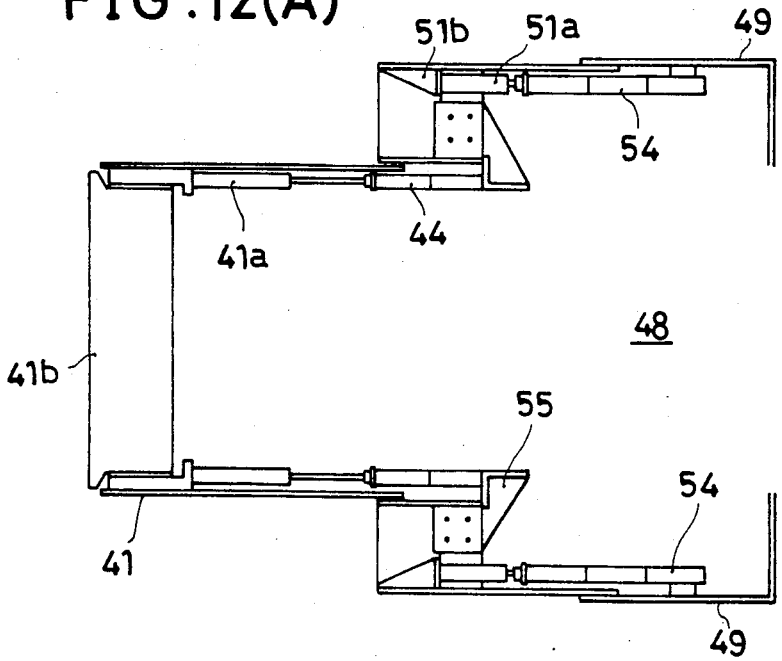
FIG. 12(A) is an explanation diagram showing a connected condition between the two shield machines in a fourth embodying example of the present invention.

First, as shown in FIG. 12(A), when the jack means 41*a* of the primary shield machine 41 is expanded, the primary shield machine 41 is driven forward by the length of one segment by a reaction resulting from the primary segments 44 engaged with the enlarging shield machine 51.

Figure 12B:
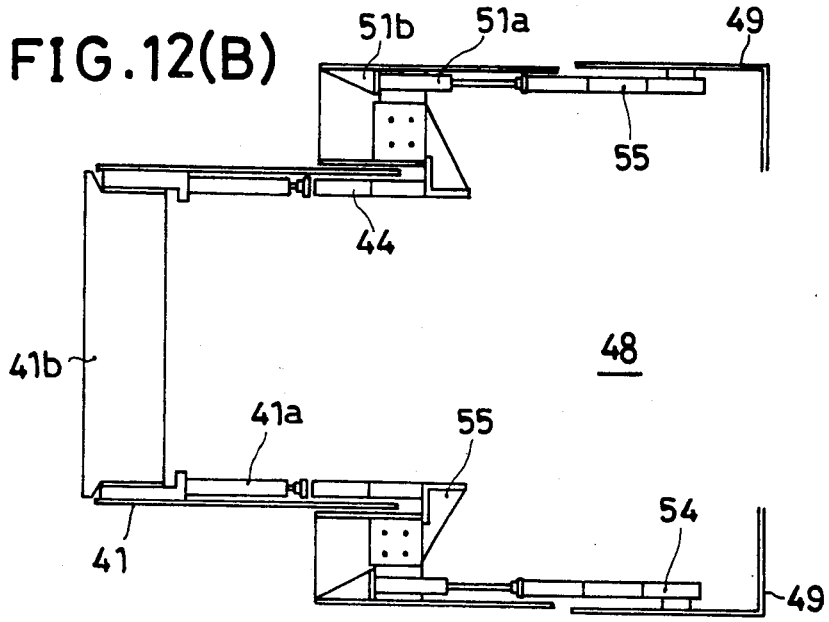
FIG. 12(B) is an explanation diagram showing a connected condition between the two shield machines wherein the jack means is in an extended condition.

Next, simultaneously when the jack means 41*a* of the primary shield machine 41 is contracted, the jack means 51*a* of the enlarging shield machine 51 is expanded against the secondary segments 54, and thereby the enlarging shield machine 51 is driven forward by the length of one segment by the resultant reaction as illustrated in FIG. 12(B).

Figure 12C:
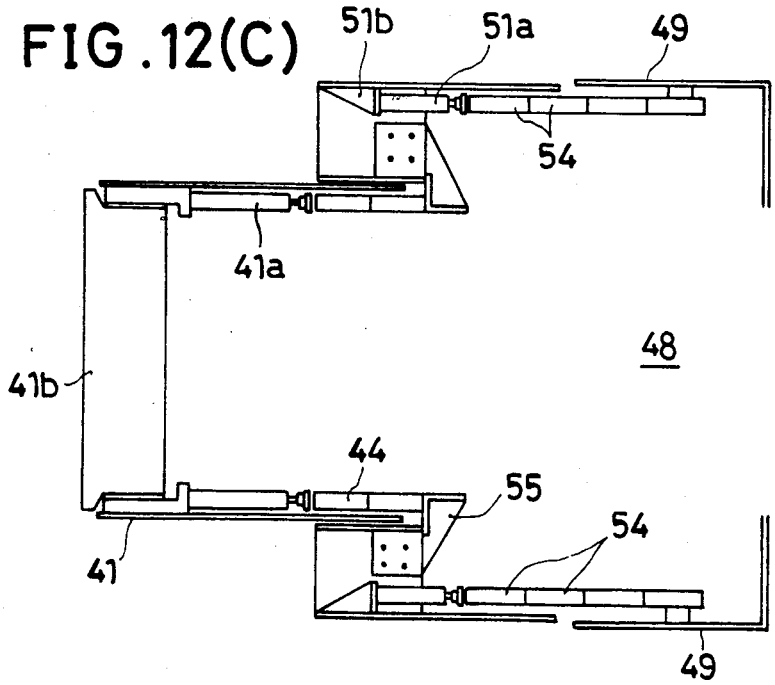
FIG. 12(C) is an explanation diagram showing a connected condition between the two shield machines wherein the jack means is in a retracted position.

Thereafter, as shown in FIG. 12(C), the jack means 51*a* of the enlarging shield machine 51 previously extended is now contracted, and an inner circumferential surface of the newly excavated enlarged portion is lined with a new ring of secondary segments 54, by means of the erector means, in such a manner that the new segment ring is connected to the previous ring secondary segment ring 54. Thereafter, the above progressive procedures are repeated, so that the primary shield machine 41 and the enlarging shield machine 51 are driven forward alternatively, whereby an enlarged tunnel in the whole range of the predetermined region to be enlarged is constructed.

Thus according to this invention, the primary shield machine and the enlarging shield machine which are assembled in an enlarged starting base formed to the rear of the primary shield machine are both driven forward along a predetermined region to be enlarged. Thereby an enlarged tunnel is completed throughout the predetermined region.

The present invention process is advantageous in that the working efficiency can be improved in comparison with a conventional process wherein a shaft is made from the surface of the ground. In addition, the present invention is an improvement over the previously proposed process wherein an ordinary diametrical tunnel is constructed in advance and thereafter a driving for enlarging the periphery of the tunnel is carried out while the primary segments previously lining the whole range of the predetermined region to be enlarged are removed in order.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving process for enlarging a tunnel comprising the following steps:

driving a primary shield machine along an ordinary diametrical tunnel to a predetermined region to be enlarged;

forming an enlarged starting base in the rear of the primary shield machine;

assembling an enlarging shield machine in the enlarged base; and driving both the primary shield machine and the enlarging shield machine forward along the predetermined region of enlargement to construct an enlarged tunnel.

2. The process according to claim 1, and further including the step of connecting the primary shield machine and the enlarging shield machine together, and driving the two machines simultaneously forward by using a driving jack means operatively connected to the enlarging shield machine.

3. The process according to claim 1, wherein the enlarged starting base is so provided that primary segments lining the ordinary diametrical tunnel may be interposed between the enlarged starting base and the primary shield machine located in front thereof, and the enlarging shield machine assembled in the enlarged starting base portion is operatively engaged with a rear end portion of the primary segments so as to be able to push the primary segments, and the primary shield machine and the enlarging shield machine are connected together through the primary segments so that the two machines may be both driven forward.

4. The process according to claim 3, wherein the enlarging shield machine is driven forward by using a jack means of the enlarging shield machine while a jack means of the primary shield machine is in its rest condition, and the primary shield machine is driven forward simultaneously with the enlarging shield machine through the primary segments pushed at the rear end portion thereof by the enlarging shield machine.

5. The process of claim 3, wherein the primary shield machine is driven forward by expanding a jack means of the primary shield machine for making the ordinary diametrical tunnel, and then the expanded jack means of the primary shield machine is contracted and at the same time a jack means of the enlarging shield machine is expanded, and thereby the enlarging shield machine is driven forward while pushing the rear end portion of the primary segments, for making an enlarged tunnel, and then the expanded jack means of the enlarging shield machine is contracted and an inner surface of the resultant enlarged tunnel portion is lined with new secondary segments, and thereafter in almost the same manner as above the primary shield machine and the enlarging shield machine are driven forward alternatively.

* * * * *